United States Patent [19]

Hansen et al.

[11] 4,199,873

[45] Apr. 29, 1980

[54] FOLDABLE PANTY HOSE DRYER

[75] Inventors: Edwin L. Hansen; Amy L. Hansen, both of Mahomet, Ill.

[73] Assignee: Veach Development Company, Inc., Los Angeles, Calif.

[21] Appl. No.: 916,879

[22] Filed: Jun. 19, 1978

[51] Int. Cl.[2] ..... F26B 9/06

[52] U.S. Cl. ..... 34/202; 34/91; 34/233

[58] Field of Search ..... 34/233 X, 243, 201, 34/202, 90, 91 X, 224, 225, 232

[56] References Cited

U.S. PATENT DOCUMENTS

| | | | |
|---|---|---|---|
| 2,260,687 | 10/1941 | Lasha | 34/202 |
| 3,509,637 | 5/1970 | Cullier | 34/243 R |
| 3,577,650 | 5/1971 | Brahm | 34/223 X |
| 4,094,076 | 6/1978 | Baslow | 34/90 |

FOREIGN PATENT DOCUMENTS

| | | | |
|---|---|---|---|
| 386456 | 1/1933 | United Kingdom | 34/201 |

*Primary Examiner*—Edward G. Favors
*Attorney, Agent, or Firm*—Victor C. Muller

[57] ABSTRACT

Apparatus for drying small laundered garments, such as women's pantyhose, characterized by a box-like compartment through which hot air may be delivered by a conventional portable hair dryer. Its walls are connected by hinges so that it may be folded to flat configuration when not in use. It may be constructed of inexpensive cardboard, utilizing conventional paper processing machines.

15 Claims, 7 Drawing Figures

FOLDABLE PANTY HOSE DRYER

BACKGROUND OF THE INVENTION

It is common practice for women to launder their hose or pantyhose at home or at a lodging and allow them to dry overnight for use the following day. On some occasions, however, the laundered and dried garments are desired in a much shorter time than is possible by air drying. Women travelers often carry in their luggage a hand held electric hot air hair dryer, and if not, can often readily borrow one from lodging personnel. The hot air blast from such a hair dryer far exceeds the drying capacity of the still air in which the garment may be hung. It follows, accordingly, that if such hot air blast could be utilized for drying a garment, the drying time might be materially reduced. It would appear, also that any device utilizing such hair dryer should, to be practical, occupy a minimum of space and be inexpensive.

SUMMARY OF THE INVENTION

The invention is characterized by a square parallelepiped box having a perforate partition disposed between its ends, forming a top open compartment for a garment and a lower closed compartment to which the nozzle of a portable hair dryer may be attached. In the interests of economy of manufacture and minimization of cost to the user, it is preferably made of cardboard with integral hinges along its corners so that it may be folded into flat form of the area of stacked sides of a rectangle and two thicknesses of cardboard, thus occupying a minimum space when being transported. Further economies of manufacture may be effected since mass production may be effected by use of conventional steel rule die apparatus employed in the paper and cardboard processing art.

A principal object of the invention accordingly, consonant with the foregoing, is to provide a collapsible small garment dryer which employs a conventional hair dryer, the entire hot air blast of which is constrained to pass through a garment.

Another object is to construct the apparatus of sheet material, preferably cardboard, having fold lines so that it may be collapsed into flat transport configuration.

Another object is to provide an adjustable connection for dryer nozzles of various sizes.

Further objects, advantages and salient features will become more apparent from the detailed description to follow, the accompanying claims, and the attached drawings, to now be briefly described.

DETAILED DESCRIPTION OF PREFERRED EMBODIMENTS

Figure 1:
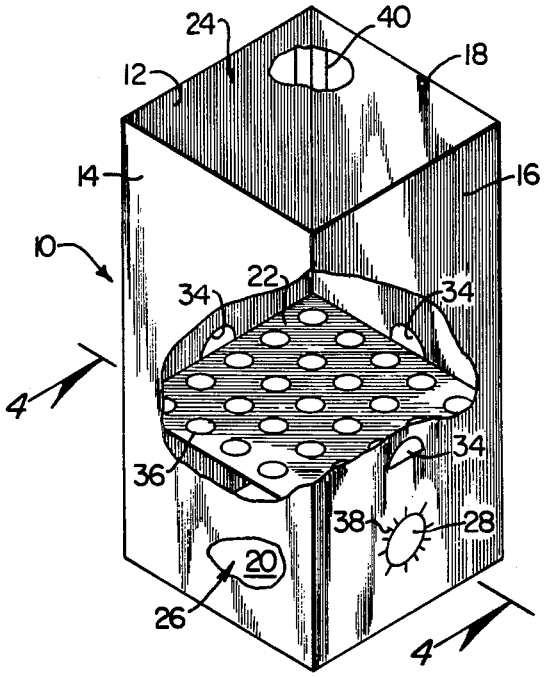
FIG. 1 is a broken away isometric of one embodiment of the invention in its assembled form.
Figure 2:
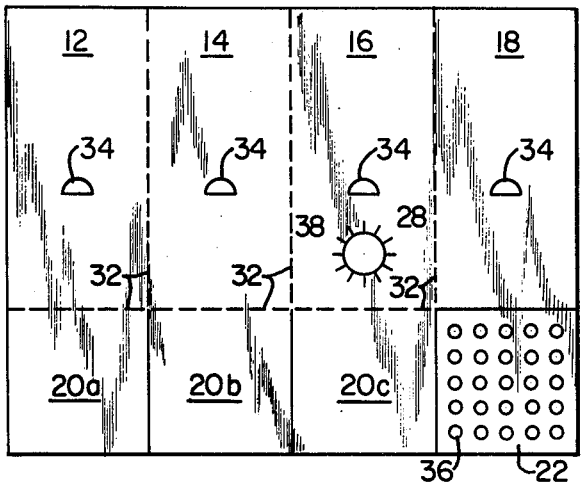
FIG. 2 is the developed form of the parts of FIG. 1.
Figure 3:
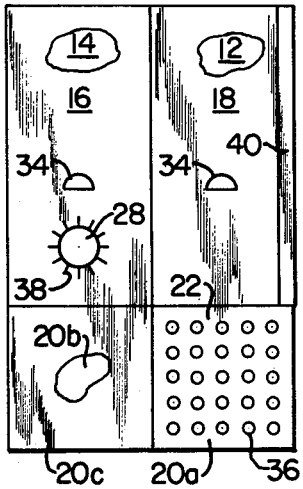
FIG. 3 is like FIG. 2, but in folded transport form.
Figure 4:
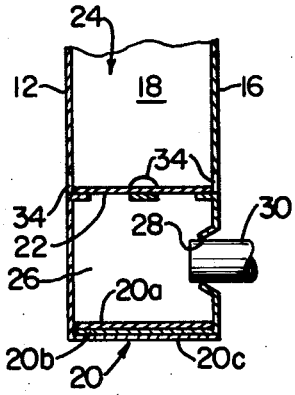
FIG. 4 is a section taken on line 4—4, FIG. 1.

Referring now to the drawing in detail, and first to FIGS. 1 to 4, the subject of the invention comprises, briefly, a square box 10 formed of four like rectangular sides 12, 14, 16, and 18, a bottom 20, a perforate partition 22 forming a drying chamber 24 thereabove, and an air distributing chamber 26 therebelow. An opening 28 is provided in one of the sides below the partition, which receives the nozzle 30 of a conventional electrically heated hot air hair dryer having an air blower (not shown). FIG. 2 illustrates box 10 in developed form before folding and assembly and in which all solid lines represent sever lines or cuts through a sheet of cardboard and dotted lines represent scores or partial cuts to provide hinges 32 along same. Semi-circular tabs 34 are cut in like manner so that they may be folded 90° to the plane of the drawing to form supports for partition 22, as better shown in FIG. 1. As will be apparent, partition 22 is substantially severed from the sheet. When folded into the position of FIG. 1, the three square portions **20*a*,20*b* and 20*c* are disposed in stacked relation, forming bottom 20, as best shown in FIG. 4. Their three aligned free edge may be secured together with a paper clip (not shown). Still referring to FIG. 2, perforations 36 are preferably formed as through cuts except for diametrically opposed small retaining tabs (not shown) and the discs may be removed by the user with a pencil or other like object. This obviates troublesome loose severed parts in the processing through a steel rule die. The aperture 28 may be formed in like manner as a punchout. The radial cuts 38, however, extend through the sheet. After the central disk is punched out, the cardboard may be bent inwardly as tabs between the cuts to fit dryer nozzles of various sizes, as illustrated in FIG. 4**.

FIG. 3 illustrates a folded transport position in which the sides 16,18 are folded and stacked on sides 14,12. The left edge of side 12 and right edge of side 18 (FIG. 2) are hingedly connected together with a strip of gummed tape 40.

Figure 6:
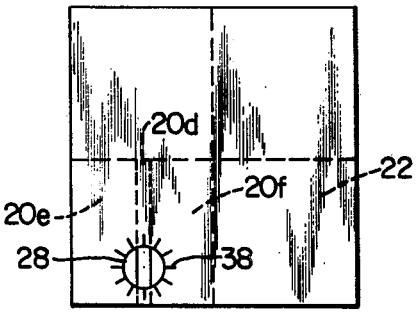
FIG. 6 is like FIG. 5, but in folded transport form comparable to FIG. 3.
Figure 5:
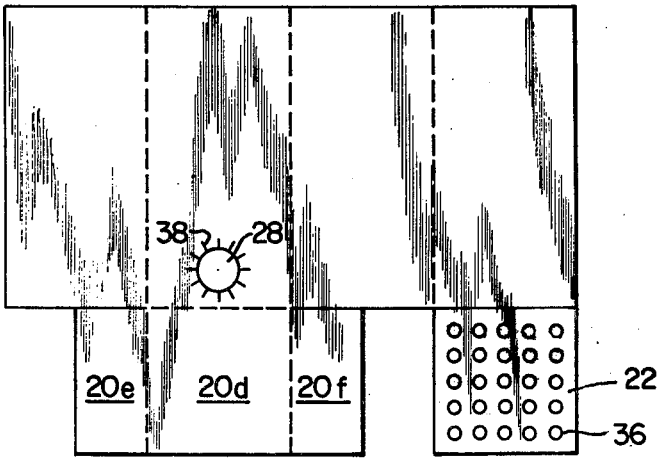
FIG. 5 is the developed form of an alternative embodiment of the invention.
Figure 7:
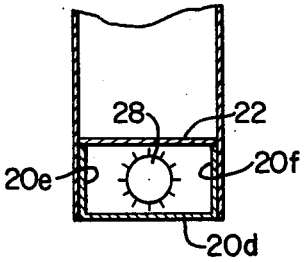
FIG. 7 is a section, like FIG. 4, of the parts of FIG. 5 in assembled form.

FIGS. 5–7 illustrate an alternative form of the invention in which bottom **20*d* is formed of a single thickness of cardboard, rather than three thicknesses, as in the previous embodiment. Wings 20*e* and 20*f*, adjacent opposite edges of bottom 20*d*, may be folded to the position shown in FIG. 7 where their upper edges form a support for partition 22, serving the purpose of tabs 34 in the previous embodiment. When in the transport position, wings 20*e*, 20*f* may be folded 180° to lie on bottom 20*d* and the assembly thence may be folded 180° so that it lies between the folded sides, as best shown in FIG. 6**.

While not shown, the bottom formed by square portions **20*a*, 20*b*, 20*c* of FIG. 3 may be folded into a position as shown in FIG. 6. Thus, in either embodiment, the area of the folded device may be that of the area of two sides, as shown in FIG. 6**.

In an exemplary method of making and marketing the invention, and with reference to FIG. 2, a rectangular sheet of cardboard is fed beneath a steel rule die and sever cuts are made at solid lines, and partial cuts made at dotted lines to provide hinges. All parts, however, are retained together with small holding tabs so that no loose pieces are cut out in the die. The sheet is then folded to the position of FIG. 3 and a flexible gum tape 40 applied to the free edges of sides, 12,18. It may then be packaged in an envelope, preferably transparent, so that printed instructions on the cardboard may be read. The user punches out disc 28, the discs in partition 22, and breaks the holding tabs of partition 22 so that it becomes a loose piece. The parts are then folded and assembled as previously described. When not in use, the parts may again be arranged to the position of FIG. 3. If the user desires to further reduce the transport area, the bottom may be folded between the sides, as shown in FIG. 6. Thus, the folded transport area may be that of two sides plus the area of twice the bottom or reduced by the latter, as shown in FIG. 6.

What I claim is:

1. Apparatus for drying garments, such a women's panty hose, for use with a conventional hand-held hair dryer having an air exhaust nozzle, comprising:

(a) a parallelepiped space enclosed by an even number of like rectangular side walls of sheet material and having a cross section the shape of a regular polygon, (b) the space being open at one end and adapted to be closed at its other end, (c) means hingedly connecting all adjacent side walls together in such manner that they may be folded into a flat rectangular stacked configuration of one half the area of the side walls, (d) a transverse removable perforate flat partition of like material disposed between its opposite ends dividing the space into an air distributing chamber adjacent its closed end and a garment drying chamber adjacent its open end, and (e) an opening in one side wall communicating with the air distributing chamber adapted to receive an end of said nozzle.

2. Apparatus in accordance with claim 1 wherein the material is cardboard and the hinge connecting means between the side walls include integral score lines therein.

3. Apparatus in accordance with claim 2 wherein parallel free edges of the cardboard are hingedly connected with a flexible tape affixed to adjacent side walls.

4. Apparatus in accordance with claim 2 including at least one integral wing hingedly connected to one of the sidewalls adapted to be folded to close said other end.

5. Apparatus in accordance with claim 4 including a plurality of like wings adapted to be folded into stacked configuration.

6. Apparatus in accordance with claim 4 wherein the partition is severed from the sheet material adjacent one of the side walls.

7. Apparatus in accordance with claim 4 including integral foldable portions on said wing having edges for supporting said partition.

8. Apparatus in accordance with claim 4 including foldable tabs in the side walls for supporting said partition.

9. Apparatus in accordance with claim 5 wherein the entire apparatus is constructed from a single rectangular sheet, and the partition is severed from one corner thereof adjacent one of the side walls.

10. Apparatus in accordance with claim 1 wherein said opening is adjustable in size to receive nozzles of varying size.

11. Apparatus for drying garments, such as women's pantyhose, for use with a conventional hand-held hair dryer having an air exhaust nozzle, comprising;

(a) a rectangular sheet of cardboard adapted to be processed by a steel rule die to form sever cuts and fold scores therein, (b) three equally spaced parallel fold scores disposed in a first rectangular portion of the sheet adapted to permit such portion to be folded to enclose a square parallelepiped space having four like side walls, (c) a flexible tape hingedly connecting opposite free edges of said first portion together, (d) a square portion substantially severed from an adjacent second portion of the sheet and substantially severed to provide a plurality of punch-outs therein to form a perforate partition adapted to be disposed between ends of said space to provide an air distributing chamber at one side thereof and a garment drying chamber at the other side thereof, (e) at least one fold score between the first and second portions and sever cuts for forming a square foldable bottom for said air distributing chamber, (f) sever cuts in one side wall between the partition and bottom to provide a punch-out opening for receiving an end of said nozzle, and (g) means for supporting the perforate partition.

12. Apparatus in accordance with claim 11 wherein said bottom is formed as three like square portions adapted to be folded into stacked configuration and said means for supporting the partition comprises foldable tabs in said side walls.

13. Apparatus in accordance with claim 11 wherein the bottom is formed as a single thickness of cardboard and provided with foldable wings having edges for supporting the partition.

14. Apparatus in accordance with claim 11 wherein said punch-out is a circular disk, and radial sever cuts extending outwardly therefrom to provide bendable tabs to engage nozzles of varying size.

15. Apparatus in accordance with claim 11 wherein said rectangular sheet may be delivered from the die with all parts attached and thence be folded to one half its area and the tape applied, the partition adapted to be torn from the sheet and its punch-outs and the punch-out for the nozzle removed by the user, whereby the apparatus may be processed, packaged, and marketed, without entailing removal of any portions of the original sheet.

* * * * *